US006609924B2

(12) United States Patent
Zeiler et al.

(10) Patent No.: US 6,609,924 B2
(45) **Date of Patent: *Aug. 26, 2003**

(54) QUICK LOCK POWER CORD

(75) Inventors: Jeffrey M. Zeiler, Delafield, WI (US); Melissa A. Ottens-Rendon, Waukeshia, WI (US); Jeffrey C. Hessenberger, Neosho, WI (US); Dragomir C. Marinkovich, Wadsworth, IL (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/118,738

(22) Filed: Apr. 9, 2002

(65) Prior Publication Data

US 2002/0115353 A1 Aug. 22, 2002

Related U.S. Application Data

(63) Continuation of application No. 09/527,789, filed on Mar. 17, 2000, now Pat. No. 6,368,133, which is a continuation-in-part of application No. 09/443,843, filed on Nov. 19, 1999, now abandoned.

(51) Int. Cl.[7] ..... H01R 4/38
(52) U.S. Cl. ..... 439/321
(58) Field of Search ..... 439/310, 311, 439/318, 321 I, 333, 368, 369, 370

(56) References Cited

U.S. PATENT DOCUMENTS

| | | | |
|---|---|---|---|
| 1,969,531 | A | 8/1934 | Swedler et al. |
| 2,890,434 | A | 6/1959 | Ray et al. |
| 3,025,490 | A | 3/1962 | Hicks |
| 3,351,886 | A | 11/1967 | Zimmerman, Jr. |
| 3,404,365 | A | 10/1968 | Obeissart |
| 3,469,044 | A | 9/1969 | Dickerson |
| 3,938,873 | A | 2/1976 | Kimball |

(List continued on next page.)

FOREIGN PATENT DOCUMENTS

| | | |
|---|---|---|
| EP | 90-480 | 1/1983 |
| EP | 0124389 | 11/1984 |

(List continued on next page.)

*Primary Examiner*—Neil Abrams
*Assistant Examiner*—Thanh Tam Le
(74) *Attorney, Agent, or Firm*—Michael Best & Friedrich LLP

(57) ABSTRACT

A power tool and a power cord. The power tool comprises a housing defining a housing thread, an electric motor, an electric circuit connected to the motor, a power cord removably connectable with the housing, the cord being connectable to a power source and to the circuit to connect the circuit to the power source, and a locking assembly for locking the power cord to the housing and to the circuit. The cord includes a cord electrical connector, and a mounting portion defining a cord thread, the cord thread being complementary to and engageable with the housing thread. The locking assembly includes a first locking member supported by one of the housing and the mounting portion, and a second locking member supported by one of the housing and the mounting portion, the first locking member being movable between a locking position, in which the first locking member engages the second locking member, and an unlocked position, in which the first locking member is disengaged from the second locking member. To connect the cord to the housing and to the circuit, the cord electrical connector is electrically connected to the circuit, the mounting portion is engaged with the housing to engage the cord thread and the housing thread, and the first locking member is moved to the locking position so that the first locking member engages the second locking member to prevent the cord thread and the housing thread from being disengaged.

16 Claims, 5 Drawing Sheets

U.S. PATENT DOCUMENTS

| | | | |
|---|---|---|---|
| 4,531,796 | A | 7/1985 | Gansert et al. |
| 4,702,539 | A | 10/1987 | Cusick, III et al. |
| 4,784,616 | A | 11/1988 | Zimmermann |
| 5,067,909 | A | 11/1991 | Behning |
| 5,118,303 | A | 6/1992 | LeBaron et al. |
| 5,458,501 | A | 10/1995 | Lazaro, Jr. et al. |
| 5,685,730 | A | 11/1997 | Cameron et al. |
| 5,741,149 | A | 4/1998 | Anthony |
| 5,829,998 | A | 11/1998 | Wandler et al. |
| 6,039,594 | A | 3/2000 | Zuppa |
| 6,091,200 | A | 7/2000 | Lenz |
| 6,135,800 | A | 10/2000 | Majors |
| 6,368,133 | B1 * | 4/2002 | Zeiler et al. ..... 439/321 |

FOREIGN PATENT DOCUMENTS

| | | |
|---|---|---|
| FR | 1.113.794 | 4/1956 |
| FR | 71.890 | 2/1960 |
| FR | 1 168 745 | 2/1960 |
| GB | 1445880 | 8/1976 |
| GB | 2 136 641 | 9/1984 |
| JP | 06290831 | 10/1994 |
| NL | 8802-529 | 5/1990 |

* cited by examiner

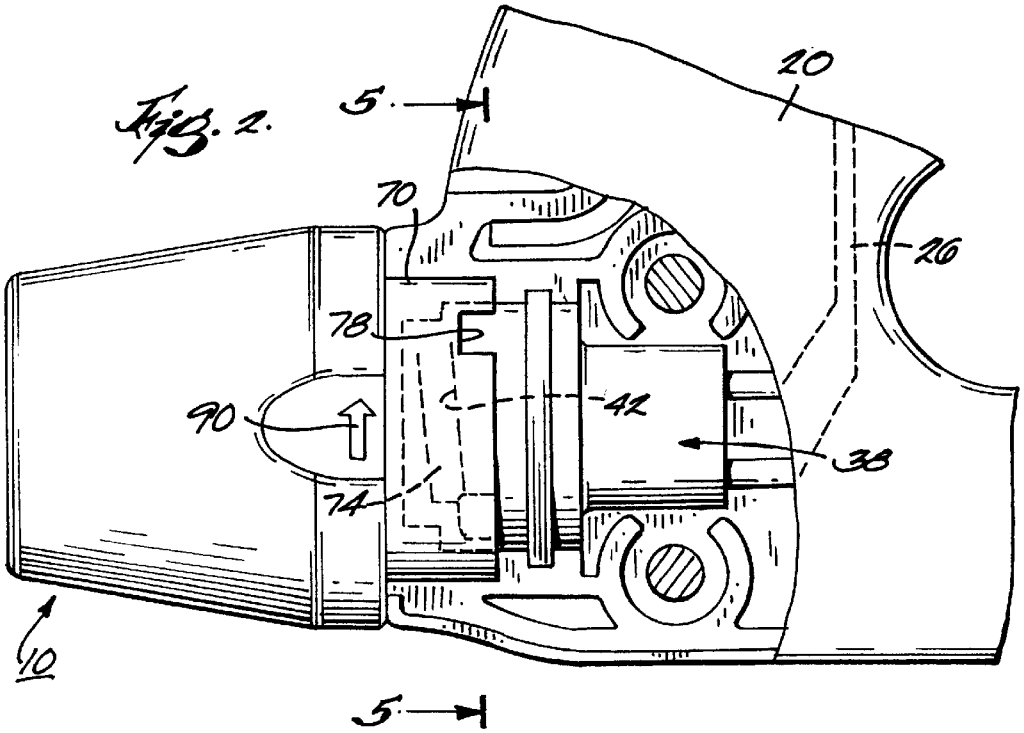
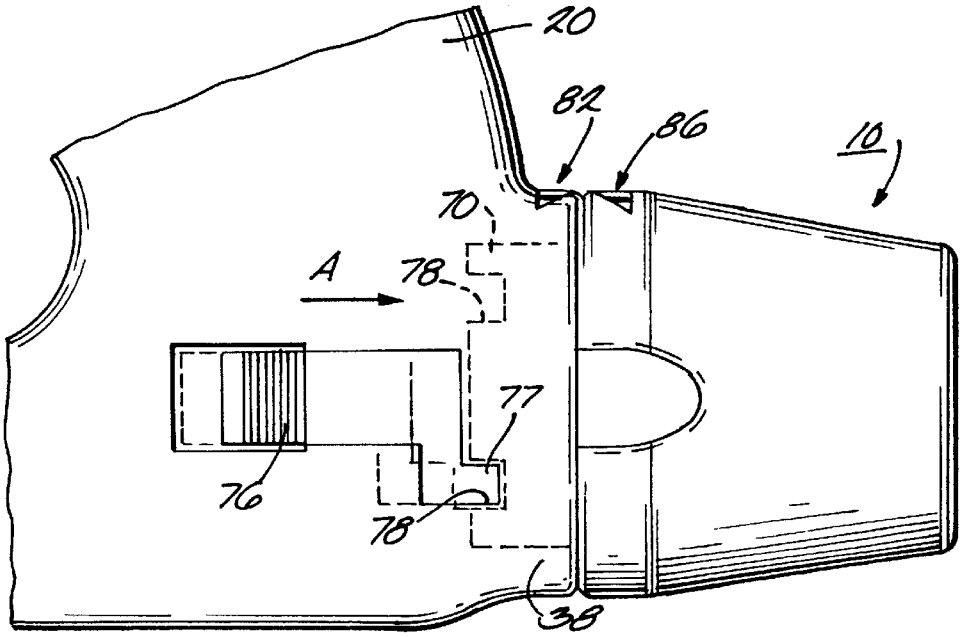
Fig. 3

QUICK LOCK POWER CORD

RELATED APPLICATIONS

This application is a continuation of prior co-pending patent application Ser. No. 09/527,789, filed Mar. 17, 2000, now U.S. Pat. No. 6,368,133 which is a Continuation-In-Part of patent application Ser. No. 09/443,843, filed Nov. 19, 1999 Now ABN.

FIELD OF THE INVENTION

The present invention relates to power tools and, more particularly, to a power cord for power tools.

BACKGROUND OF THE INVENTION

A power tool, such as a circular saw, generally includes a housing supporting an electric motor which drives a tool element, such as a saw blade. The motor is electrically connected to an electrical power source by a power cord. Typically, the power cord is directly wired to the electrical circuit of the motor, such as to the on/off switch, and is non-removably fixed to the housing or handle of the power tool.

SUMMARY OF THE INVENTION

One independent problem with the above-described power tool is that, if the power cord is damaged or accidentally severed during cutting operations, a cord must be rewired to the electrical circuit. In order to rewire the new cord, the handle of the power tool is disassembled and the new cord is directly wired to the on/off switch. Alternatively, if a sufficient length of the damaged cord is still connected to the power tool, a new plug is rewired to the severed end of the cord. In either case, rewiring of the power cord is time consuming and inconvenient. Also, suitable cords and plugs may not be readily available at a work site for replacement of or attachment to the damaged cord.

Another independent problem with the above-described power tool is that, occasionally, an operator will suspend the power tool by the cord. If the cord is not properly and securely connected to the power tool, the body of the power tool can separate from the cord and fall, possibly injuring another worker or damaging the power tool.

The present invention provides a power cord for a power tool that alleviates one or more of the above-described and other problems with the above-described power tools. The invention provides a power cord that is removable and replaceable. Also, the present invention provides a power cord that can be positively locked to the housing of the power tool to prevent the power cord from being inadvertently disconnected from the electrical circuit and from the housing of the power tool.

In particular, the present invention provides a power tool including a housing defining a housing thread, an electric motor supported by the housing and operable to drive a tool member, and an electrical circuit connected to the motor. The power tool also includes a power cord connectable to the housing and to the circuit and operable to connect the circuit to the power source. The cord defines a cord thread complementary to and engageable with the housing thread.

The power tool further includes a locking assembly for locking the cord to the housing and to the circuit. The locking assembly includes a first locking member supported by one of the housing and the cord and a second locking member supported by one of the housing and the cord. The first locking member is movable between a locking position, in which the first locking member and the second locking member are engaged, and an unlocked position, in which the first locking member and the second locking member are disengaged.

To connect the cord, the cord is electrically connected to the circuit. The cord is engaged with the housing so that the cord thread engages the housing thread. The first locking member is then moved to the locking position to prevent the cord thread and the housing thread from being disengaged.

Preferably, the first locking member includes a locking projection, and the second locking member is a recess engageable by the locking projection in the locking position. Preferably, the locking member is slidable generally parallel to the axis of the member on which it is supported between the locking position and the unlocked position.

The cord preferably includes a mounting portion is preferably rotatable relative to the cord electrical connector and relative to the support portion to engage the cord thread and the housing thread. Also, the power tool preferably includes an indicator to indicate when the cord is locked to the housing.

In one construction, the first locking member is preferably supported on the support portion, and the second locking member is preferably supported on the mounting portion. In an alternative construction, both locking members of the locking assembly are supported on the cord. In the alternative construction, the first locking member is supported on the mounting portion, and the second locking member is supported on the cord electrical connector housing.

In addition, the present invention provides a method of assembling a power tool, the method comprising electrically connecting the cord and the circuit, engaging the cord and the housing so that the cord thread engages the housing thread, and moving the first locking member to the locking position to engage the second locking member to prevent the cord thread and the housing thread from being disengaged. The cord is thus positively locked with the housing and with the circuit.

One independent advantage of the present invention is that the power cord is quickly and easily removable and replaceable if the cord is damaged or severed.

Another independent advantage of the present invention is that the power cord is positively locked to the housing to ensure that the cord is electrically connected to the circuit and to ensure that that cord is physically connected to the housing. Also, in order to remove the cord, the operator must perform two separate and distinct motions. The first locking member must be moved to the unlocked position, and the mounting portion must then be rotated relative to the housing to disengage the threads. This reduces the likelihood of the cord being inadvertently disconnected from the housing.

Yet another independent advantage of the present invention is that, in the construction in which the both locking members of the locking assembly are supported on the cord, such a cord may be used with a power tool capable of accommodating a removable cord. Such a cord provides a positive locking arrangement without modification of the power tool (i.e., providing one of the locking members on the power tool).

Other independent features and independent advantages of the invention will become apparent to those skilled in the art upon review of the following detailed description, claims and drawings.

DESCRIPTION OF THE DRAWINGS

FIG. 2 is a side view of the power tool and power cord shown in FIG. 1 with portions cut away.

FIG. 3 is a side view of the power tool and the power cord shown in FIG. 1.

Figure 1:
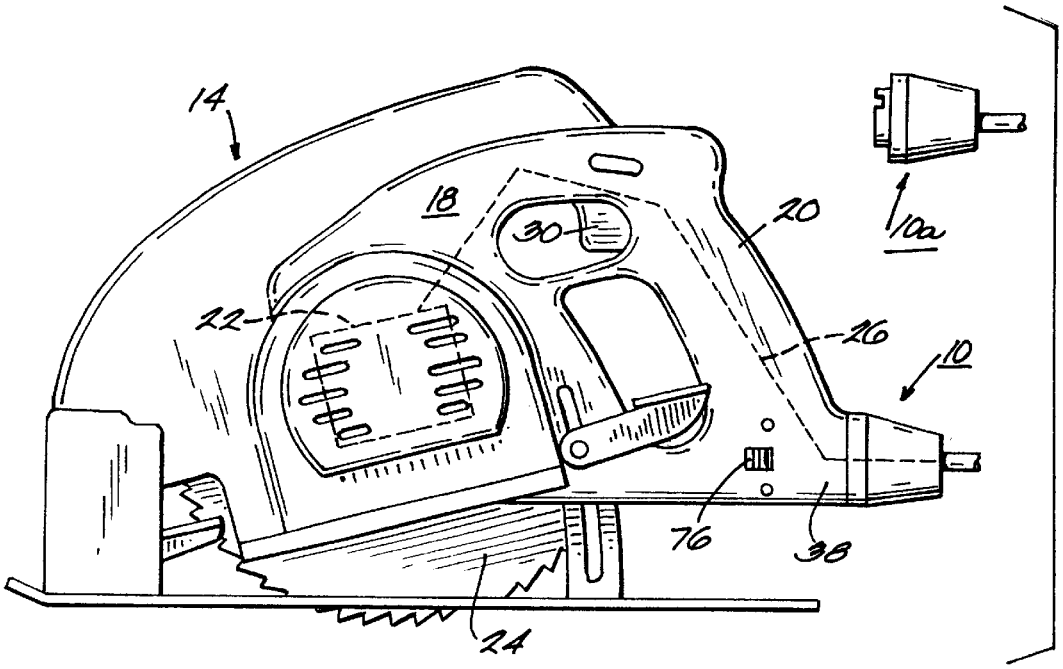
FIG. 1 is a side view of a power tool including a power cord embodying the invention.
Figure 5:
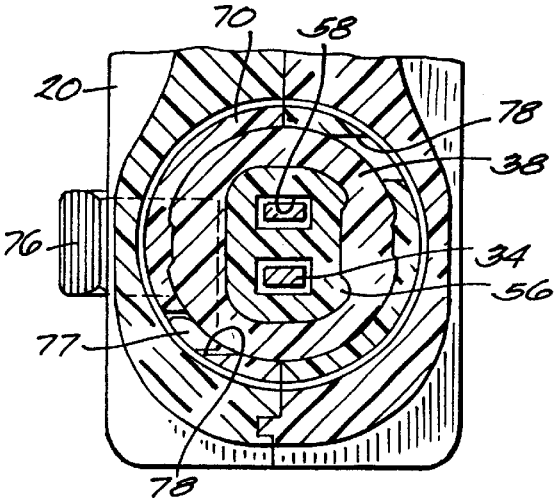
FIG. 5 is a cross-sectional view taken generally along line 5—5 in FIG. 2.

Before one embodiment of the invention is explained in detail, it is to be understood that the invention is not limited in its application to the details of the construction and the arrangements of the components set forth in the following description or illustrated in the drawings. The invention is capable of other embodiments and of being practiced or carried out in various ways. Also, it is understood that the phraseology and terminology used herein is for the purpose of description and should not be regarded as limiting.

DETAILED DESCRIPTION OF THE PREFERRED EMBODIMENT

A power tool including a power cord 10 embodying the invention is illustrated in FIG. 1. In the illustrated construction, the power tool is a circular saw 14. However, in other constructions (not shown), the power tool may be any type of electric power tool, such as, for example, a drill or reciprocating saw.

Figure 4:
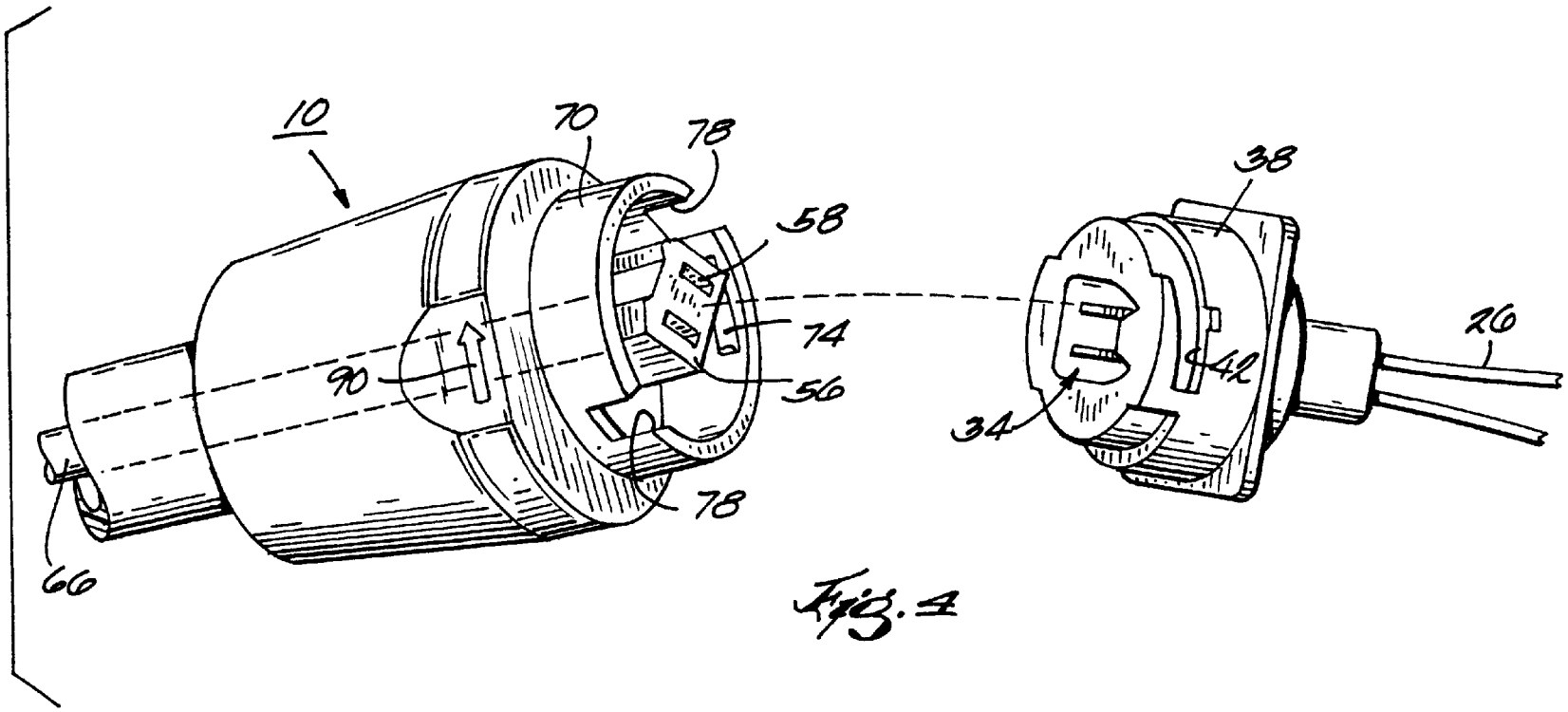
FIG. 4 is a perspective view of a portion of the power tool and power cord shown in FIG. 1 and illustrating the power cord disconnected from the power tool.

The circular saw 14 includes a motor housing 18 having a handle portion 20. An electric motor 22 (shown schematically) is supported by the housing 18 and is operable to drive a tool member, such as a saw blade 24. The motor 22 is electrically connected by an electrical circuit 26 to an on/off switch 30 supported on the handle portion 20. The circuit 26 includes (see FIG. 4) a circuit electrical connector 34 for connection with the power cord 10.

A support portion 38 is defined by the handle 20 and supports the circuit electrical connector 34. The support portion 38 supports the power cord 10, when connected to the housing 18. The support portion 38 defines at least one and, preferably, more than one housing thread 42.

The power cord 10 includes (see FIG. 4) a cord electrical connector housing 56 supporting a cord electrical connector 58 and a plug (not shown) connected by a conductive wire 66 to the cord electrical connector 58. The cord electrical connector 58 is electrically connectable to the circuit electrical connector 34, and the plug is connectable to a power source to electrically connect the electrical circuit 26 and the motor 22 to the power source.

The power cord 10 is removably connectable to the housing 18 and also includes a mounting portion 70 supporting and surrounding the cord electrical connector housing 56 and the cord electrical connector 58. The mounting portion 70 is rotatable relative to the cord electrical connector housing 56 and relative to the cord electrical connector 58. The mounting portion 70 defines at least one and, preferably, more than one cord thread 74. The cord threads are complementary to and engage with the housing threads 42.

The power tool and the power cord 10 include a locking assembly for positively locking the power cord 10 to the power tool. The locking assembly includes a first locking member or slider 76. In one construction (see FIGS. 1–5), the slider 76 is supported on the support portion 38. The slider 76 includes (see FIG. 3) a locking protrusion 77. The slider 76 is slidable along an axis generally parallel to the axis of the support portion 38 between a locking position (shown in solid lines in FIG. 3) and an unlocked position (shown in phantom lines in FIG. 3). A spring (not shown) biases the slider 76 toward the locking position (in a direction indicated by arrow A).

The locking assembly also includes a second locking member or locking recess 78. In the construction illustrated in FIGS. 1–5, the mounting portion 70 also defines the locking recess 78. The locking recess 78 is engageable by the locking protrusion 77 of the slider 76 to prevent rotation of the mounting portion 70 relative to the support portion 38. The slider 76 and the recess 78 thus provide the locking assembly for the power cord 10 and the power tool.

It should be understood that, in other constructions (not shown), a slider (similar to the slider 76) may be supported on the mounting portion 70, and a locking recess (similar to the locking recess 78) may be defined by the support portion 38. In such a construction, the slider on the mounting portion 70 engages the locking recess defined by the support portion 38 to positively lock the power cord 10 to the power tool.

As shown in FIG. 3, indicator members or arrows 82 and 86 are formed on the support portion 38 and the mounting portion 70, respectively, to provide an indication to the operator as to the locked condition of the power cord 10. When the arrow 82 formed on the support portion 38 is aligned with the arrow 86 formed on the mounting portion 70, the power cord 10 is in a locked condition (the cord threads 74 are engaged with the housing threads 42). As shown in FIG. 2, a directional arrow 90 formed on the mounting portion 70 indicates the direction of rotation of the mounting portion 70 to the unlocked condition.

To mount the power cord 10, the slider 76 is moved to the unlocked position (in the direction opposite to arrow A in FIG. 3). The mounting portion 70 is inserted into the support portion 38, and the cord electrical connector 58 is connected to the circuit electrical connector 34. The mounting portion 70 is then rotated in the direction opposite to the arrow 90 (in FIG. 2) relative to the support portion 38 and relative to the electrical connectors 34 and 58 so that the threads 42 and 74 engage. When the arrows 82 and 86 are aligned, the power cord 10 has been rotated to the locked condition. The slider 76 is then released and moves under the force of the biasing spring to the locked position (in the direction arrow A in FIG. 3). The locking protrusion 77 engages in the locking recess 78 to prevent the mounting portion 70 from rotating relative to the support portion 38 and to prevent the threads 42 and 74 from being disengaged. In this manner, the power cord 10 is positively locked to the power tool.

In the illustrated construction, the slider 76 is held in the unlocked position by an operator until the power cord 10 has been rotated to the locked condition. The operator then releases the slider 76, allowing the slider 76 to move to the locking position.

In other constructions (not shown), the insertion of the mounting portion 70 into the support portion moves the slider 76 to the unlocked position. The mounting portion 70 cooperates with the slider 76 to move the slider 76 to the unlocked position. In such constructions, once the power cord 10 is rotated to the locked condition, the slider 76 is allowed to move to the locking position.

To remove the power cord 10 from the power tool, the mounting procedure is simply reversed. The slider 76 is moved to the unlocked position (in the direction opposite to arrow A in FIG. 3) so that the locking protrusion 77 is removed from the locking recess 78. The mounting portion 70 is rotated in the direction of the arrow 90 (in FIG. 2) relative to the support portion 38 so that the threads 42 and 74 disengage. The mounting portion 70 is then removed from the support portion 38, and the cord electrical connector 58 is disconnected from the circuit electrical connector 34. A new power cord 10*a* (see FIG. 1) similar to the power cord 10 may then be connected to the circular saw 14 in the manner described above.

Figure 6:
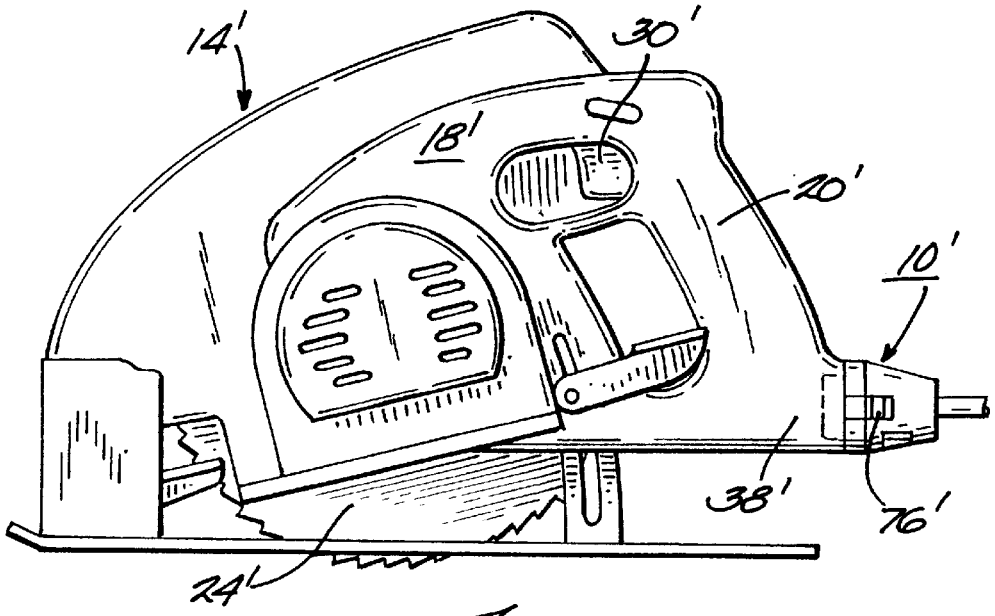
FIG. 6 is a side view of a power tool including an alternative construction of a power cord embodying the invention.
Figure 7:
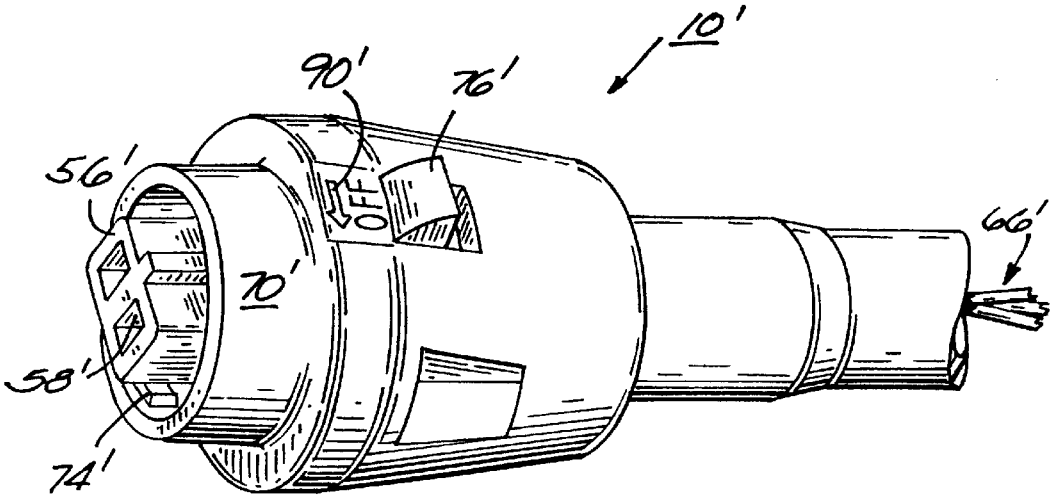
FIG. 7 is a perspective view of the power cord illustrated in FIG. 6.
Figure 8:
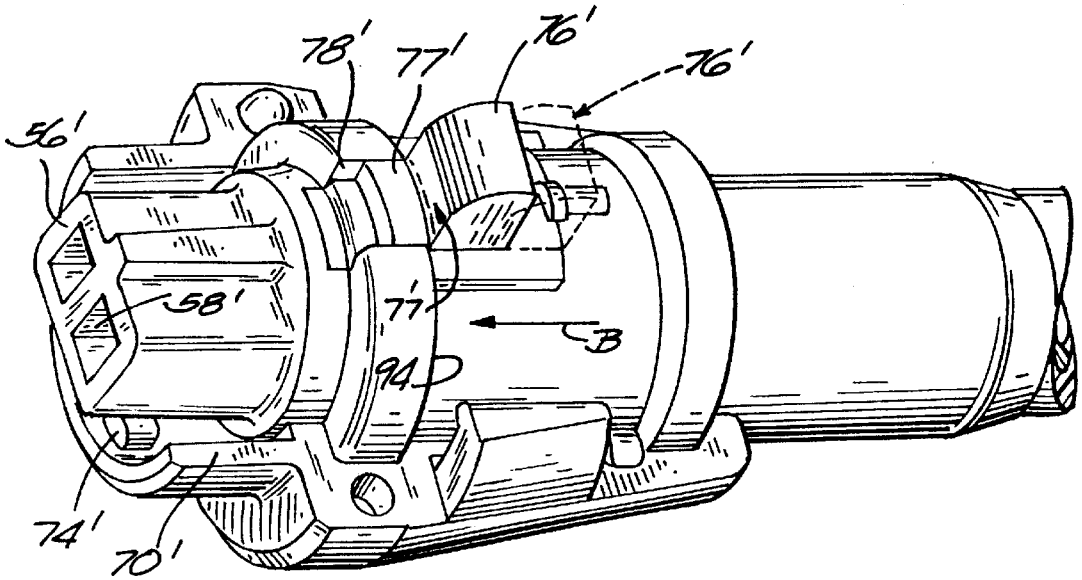
FIG. 8 is a perspective view of the power cord illustrated in FIG. 6 with portions cut away.

FIGS. 6–8 illustrate an alternative construction of a power cord 10' embodying the invention. Common elements are identified by the same reference number"'".

In the alternative construction, the locking assembly includes a first locking member or slider 76' supported on the mounting portion 70' of the power cord 10'. The slider 76' includes (see FIG. 8) a locking protrusion 77'. The slider 76' is slidable along an axis generally parallel to the axis of the mounting portion 70' between a locking position (shown in solid lines in FIG. 8) and an unlocked position (shown in phantom lines in FIG. 8). A spring (not shown) biases the slider 76' toward the locking position (in a direction indicated by arrow B).

The locking assembly also includes a second locking member or locking recess 78' formed on the cord electrical connector housing 56' of the power cord 10'. The locking recess 78' is engageable by the locking protrusion 77' of the slider 76' to prevent rotation of the mounting portion 70' relative to the cord electrical connector housing 56' and relative the support portion 38'(when the power cord 10' is connected to the power tool). The slider 76' and the recess 78' thus provide the locking assembly for the power cord 10' and the power tool.

To mount the power cord 10', the slider 76' is moved to the unlocked position (in the direction opposite to arrow B in FIG. 8). The mounting portion 70' is inserted into the support portion 38'(see FIG. 6), and the cord electrical connector 58' is connected to the circuit electrical connector (not shown but similar to the circuit electrical connector 34). The mounting portion 70' is then rotated in the direction opposite to the arrow 90'(in FIG. 7) relative to the support portion 38' and relative to the circuit electrical connector and the cord electrical connector 58' so that the housing threads (not shown) and the cord threads 74' engage. When the arrows of the indicator (not shown) are aligned, the power cord 10' has been rotated to the locked condition. The slider 76' is then released and moves under the force of the biasing spring to the locking position (in the direction arrow B in FIG. 8). The locking protrusion 77' engages in the locking recess 78' to prevent the mounting portion 70' from rotating relative to cord electrical connector housing 56' and relative to the support portion 38' and to prevent the cord threads 74' and the housing threads from being disengaged. In this manner, the power cord 10' is positively locked to the power tool.

In the construction illustrated in FIGS. 6–8, the slider 76' is held in the unlocked position by engagement with a ridge 94 formed on the cord electrical connector housing 56' until the power cord 10' has been rotated to the locked condition. The slider 76' is then disengaged from the ridge 94, allowing the slider 76' to move to the locking position.

To remove the power cord 10' from the power tool, the mounting procedure is simply reversed. The slider 76' is moved to the unlocked position (in the direction opposite to arrow B in FIG. 8) so that the locking protrusion 77' is removed from the locking recess 78'. The mounting portion 70' is rotated in the direction of the arrow 90'(in FIG. 7) relative to the cord electrical connector housing 56' and relative to the support portion 38' so that the housing threads and the cord threads 74' disengage. The mounting portion 70' is then removed from the support portion 38', and the cord electrical connector 58' is disconnected from the circuit electrical connector. A new power cord (not shown but similar to the power cord 10') may then be connected to the circular saw 14' in the manner described above.

The invention thus provides a power cord 10 or 10' which may be easily removed and replaced if damaged during cutting operations. Also, the invention provides a power cord 10 or 10' which is positively locked to the power tool to ensure electrical and physical connection of the power cord 10 or 10' and the power tool.

It should be understood that, in other constructions (not shown), the first locking member 76 or 76' may engage the locking recess 78 or 78' in a direction other than parallel to the axis, such as, for example, in a radial direction. Further, the first locking member 76 or 76' may be supported for movement other than sliding movement, such as, for example, pivotal movement.

Various features of the invention are set forth in the following claims.

We claim:

1. A power cord comprising:

a cord electrical connector;

a cord electrical connector housing supporting the cord electrical connector;

a mounting portion supporting and being rotatable relative to the cord electrical connector housing; and a locking assembly including a first locking member supported by the mounting portion, and a second locking member supported by the cord electrical connector housing, one of the first locking member and the second locking member being movable between a locking position, in which the first locking member and the second locking member are engaged to prevent rotation of the mounting portion relative to the cord electrical connector housing, and an unlocked position, in which the first locking member and the second locking member are disengaged.

2. The power cord as set forth in claim 1 wherein the first locking member is movable between the locking position and the unlocked position.

3. The power cord as set forth in claim 1 wherein the first locking member includes a locking projection, and wherein the second locking member is a locking recess engageable by the locking projection in the locking position.

4. The power cord as set forth in claim 1 wherein the mounting portion defines an axis, and wherein the one of the first locking member and the second locking member is slidable parallel to the axis between the locking position and the unlocked position.

5. A power cord for use with an electrical component, the electrical component including a housing defining a housing thread and an electrical circuit including a circuit electrical connector, the power cord comprising:

a cord electrical connector connectable to the circuit electrical connector;

a cord electrical connector housing supporting the cord electrical connector;

a mounting portion supporting and being rotatable relative to the cord electrical connector housing, the mounting portion defining a cord thread complementary to and engageable with the housing thread, the mounting portion being rotatable relative to the housing to engage the cord thread with the housing thread; and a locking assembly including a first locking member supported by the mounting portion, and a second locking member supported by the cord electrical connector housing, one of the first locking member and the second locking member being movable between a locking position, in which the first locking member and the second locking member are engaged, and an unlocked position, in which the first locking member and the second locking member are disengaged;

wherein, to connect the cord, the cord electrical connector is electrically connected to the circuit electrical connector, the mounting portion is rotated relative to the support portion to engage the cord thread and the housing thread, and the one of the first locking member and the second locking member is moved to the locking position so that the first locking member and the second locking member are engaged to prevent the cord thread and the housing thread from being disengaged.

6. The power cord as set forth in claim 5 wherein the electrical component is a power tool including a power tool housing defining the housing thread and a motor supported by the housing, wherein the electrical circuit is electrically connected to the motor, and wherein the cord electrical connector is connectable to the circuit electrical connector to connect the power cord to the motor.

7. The power cord as set forth in claim 5 wherein the first locking member is movable between the locking position and the unlocked position.

8. The power cord as set forth in claim 5 wherein the first locking member includes a locking projection, and wherein the second locking member is a locking recess engageable by the locking projection in the locking position.

9. The power cord as set forth in claim 5 wherein the mounting portion defines an axis, and wherein the one of the first locking member and the second locking member is slidable parallel to the axis between the locking position and the unlocked position.

10. The power cord as set forth in claim 5 and further comprising an indicator including an indicator member defined by the mounting portion, the indicator member being aligned relative to a housing indicator member when the cord thread is engaged with the housing thread.

11. A power tool comprising:

a housing defining a housing thread;

an electric motor supported by the housing and operable to drive a tool member;

an electric circuit connected to the motor and operable to connect the motor to a power source;

a power cord connectable with the housing and the circuit, the cord being connectable to the power source and to the circuit to connect the circuit to the power source, the cord defining a cord thread complementary to and engageable with the housing thread; and a locking assembly including a first locking member supported by one of the housing and the cord, the first locking member including a locking projection and an actuator portion engageable by an operator to move the locking projection, and a second locking member supported by one of the housing and the cord, the second locking member being a locking recess, the first locking member being movable between a locking position, in which the locking projection engages the locking recess, and an unlocked position, in which the first locking member is disengaged from the second locking member, the operator engaging the actuator portion to at least move the first locking member to the unlocked position;

wherein, to connect the cord, the cord is connected to the circuit, the cord is engaged with the housing so that the cord thread and the housing thread are engaged, and the first locking member is moved to the locking position to prevent the cord thread and the housing thread from being disengaged.

12. The power tool as set forth in claim 11 wherein one of the housing and the power cord defines an axis, and wherein the one of the first locking member and the second locking member is slidable parallel to the axis between the locking position and the unlocked position.

13. The power tool as set forth in claim 11 and further comprising an indicator including a first indicator member defined by the housing, and a second indicator member defined by the mounting portion, the first indicator member being aligned relative to the second indicator member when the cord thread is engaged with the housing thread.

14. The power tool as set forth in claim 11 wherein the electrical circuit includes a circuit electrical connector, and wherein the power cord includes a cord electrical connector connectable to the circuit electrical connector, a cord electrical connector housing supporting the cord electrical connector, and a mounting portion supporting and being rotatable relative to the cord electrical connector housing, the mounting portion defining the cord thread complementary to and engageable with the housing thread, the mounting portion being rotatable relative to the housing to engage the cord thread with the housing thread.

15. The power tool as set forth in claim 14 wherein the first locking member is supported by the cord electrical connector housing and the second locking member is supported by the mounting portion.

16. The power tool as set forth in claim 14 wherein the mounting portion defines an axis, and wherein the one of the first locking member and the second locking member is slidable parallel to the axis between the locking position and the unlocked position.

* * * * *